United States Patent [19]

Tatro

[11] 4,433,610

[45] Feb. 28, 1984

[54] OPEN BOLT FIRING MECHANISM FOR AUTOMATIC FIREARM

[75] Inventor: Henry J. Tatro, Westfield, Mass.

[73] Assignee: Colt Industries Operating Corp., West Hartford, Conn.

[21] Appl. No.: 290,724

[22] Filed: Aug. 6, 1981

[51] Int. Cl.[3] ..... F41D 11/02

[52] U.S. Cl. ..... 89/148; 89/149

[58] Field of Search ..... 89/141, 142, 143, 145, 89/148, 149

[56] References Cited

U.S. PATENT DOCUMENTS

| | | | |
|---|---|---|---|
| 1,786,536 | 12/1930 | Holek | 89/148 |
| 2,383,487 | 8/1945 | Johnson, Jr. | 89/142 |
| 3,618,455 | 11/1971 | Plumer et al. | 89/132 |
| 3,960,053 | 6/1976 | Conley | 89/149 |
| 4,057,003 | 11/1977 | Atchisson | 89/138 |

*Primary Examiner*—Stephen C. Bentley

*Attorney, Agent, or Firm*—Radford W. Luther; Richard A. Dornon

[57] ABSTRACT

An open bolt firing mechanism for an automatic firearm (10) has a reciprocating bolt assembly (20) with a sear abutment (32) which is engaged by a searing surface (46) on a hammer (36) during counter-recoil for terminating forward movement of the bolt assembly in a cocked position. An automatic sear (56) serves to pivot the hammer downwardly and produce disengagement of the sear abutment of the bolt assembly and the searing surface on the hammer which allows the bolt assembly to move into the battery position. A connector (76), which is pivotable in response to the pulling of a trigger (86), functions to displace the automatic sear for producing downward pivoting of the hammer. The automatic sear has a searing surface (54) which engages a sear abutment (52) on the hammer for retaining the hammer in a cocked position. A shoulder (106) on the bolt carrier (**20*a*) of the bolt assembly is adapted to engage a leg (68) on the automatic sear as the bolt assembly moves into the battery position. The engagement between the shoulder and the automatic sear produces rotation of the automatic sear and disengagement between the sear abutment on the hammer and the searing surface on the automatic sear which allows the hammer to fall to a fired position where it strikes a firing pin (20*c***).

8 Claims, 12 Drawing Figures

OPEN BOLT FIRING MECHANISM FOR AUTOMATIC FIREARM

TECHNICAL FIELD

This invention relates to automatic firearms and more particularly to open bolt firing mechanism therefor.

BACKGROUND ART

An automatic firearm, which has been fired repeatedly and continously, may have the temperature of its firing chamber raised to a point which could engender cook-off of a cartridge disposed therein. Cook-off is that phenomenon where a chambered cartridge fires without being struck by the firing pin of the firearm. The prior art has recognized the aforementioned problem and in response thereto has provided open bolt firing mechanisms which hold the breech bolt in retracted position after automatic firing, thereby preventing a live round from remaining in the hot firing chamber. Examples of open bolt firing mechanisms may be found in U.S. Pat. Nos. 2,383,487; 3,618,455; 3,960,053 and 4,057,003. State of the art open bolt firing mechanisms, however, are not of simple construction and embody a relatively large number of component parts.

DISCLOSURE OF THE INVENTION

In accordance with the invention, there is provided, for an automatic firearm of the type having a bolt assembly, a firing mechanism adapted for open bolt firing which is of simple construction and embodies a minimum number of component parts. A firing mechanism of the invention is advantageous in that it may readily be incorporated into the standard M16 rifle.

Succinctly stated, an open bolt firing mechanism of the invention is distinguishable from the prior art in that the hammer thereof performs a dual function in that it not only operates as a conventional hammer but also acts as a carrier sear. The basic elements of a firing mechanism of the invention are a bolt assembly, a hammer, an automatic sear, a connector and a trigger. The hammer includes a searing surface which engages a sear abutment on the bolt assembly for terminating counter-recoil upon trigger release and also for holding the bolt assembly in the cocked position. The automatic sear also performs a twofold function because it serves to pivot the hammer in response to trigger pull and thereby ultimately produce disengagement of the sear abutment of the bolt assembly and the searing surface on the hammer, whereby the bolt assembly may move into the battery position. The automatic sear, of course, performs its traditional function in releasing the hammer for movement to the fired position as the bolt assembly assumes its battery position.

Accordingly, it is a primary object of the invention to provide an open bolt firing mechanism for an automatic weapon.

Another object is to provide an open bolt firing mechanism which is of simple construction and embodies a minimum number of component parts.

These and other objects and advantages of the invention will become more readily apparent from the following detailed description, when taken in conjunction with the accompanying drawings, in which:

BRIEF DESCRIPTION OF DRAWINGS

FIG. 2 is a side elevational view, partially in section, of the receiver section of the Firearm of FIG. 1 with the components of the firing mechanism shown in the cocked position with the safety on.

BEST MODE OF CARRYING OUT THE INVENTION

Figure 1:
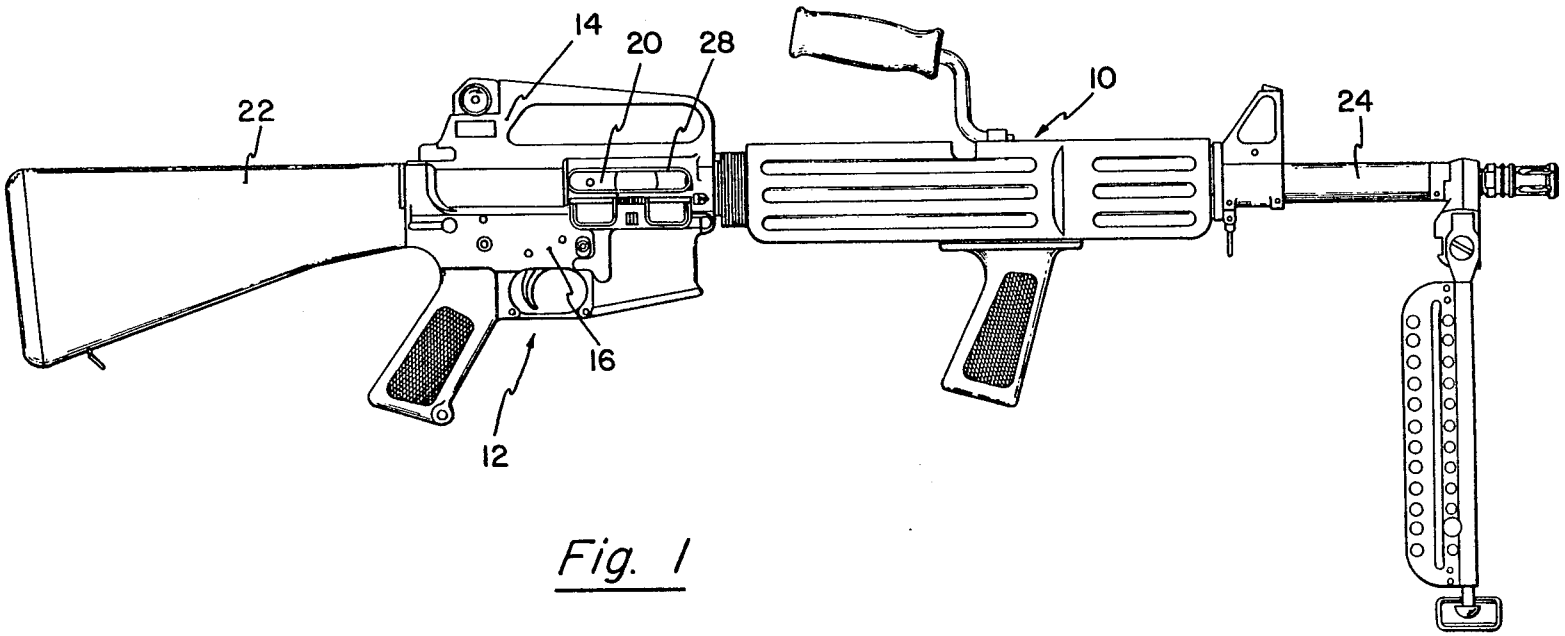
FIG. 1 is a side elevational view of an automatic firearm incorporating an open bolt firing mechanism according to the invention

Referring to the drawings, and more particularly to FIG. 1, there is shown a generally conventional M16 type gas operated firearm 10 incorporating an open bolt firing mechanism according to the invention. A receiver, generally shown at 12, includes upper receiver section 14 and a lower receiver section 16. The receiver 12 has a chamber 18 for receiving a bolt assembly 20. The rear portion of the chamber 18 is defined by the usual receiver extension **18*a* (FIG. 2) located in the stock 22 for receiving a buffer and operating spring. Connected to the forward portion of the chamber 18 is a barrel 24** having a cartridge chamber in which a cartridge may be positioned.

In general, a firearm of the invention operates much like a standard M-16 except that it is initially fired with the bolt assembly in a partially retracted or open bolt cocked position and returns to such a position when the trigger is released and the cartridges in the magazine have not yet been fully expended. The firing of a cartridge causes the bullet to travel outwardly through the bore of the barrel 24 under the impetus of expanding gases. Some of these gases are diverted through a gas port (not shown) and ultimately reach a passage 26 (FIG. 2) in the bolt assembly 20 whereupon automatic recoil of the bolt assembly 20 is occasioned. The automatic recoil of the bolt assembly 20 results in ejection of a spent cartridge through ejection window 28. The bolt assembly 20 then travels forwardly in counterrecoil, whereupon it strips and subsequently chambers a new cartridge from the magazine. The aforementioned construction and means for providing the automatic recoil are depicted and described in U.S. Pat. No. 2,951,424, issued to E. M. Stoner on Sept. 6, 1980.

Figure 2:
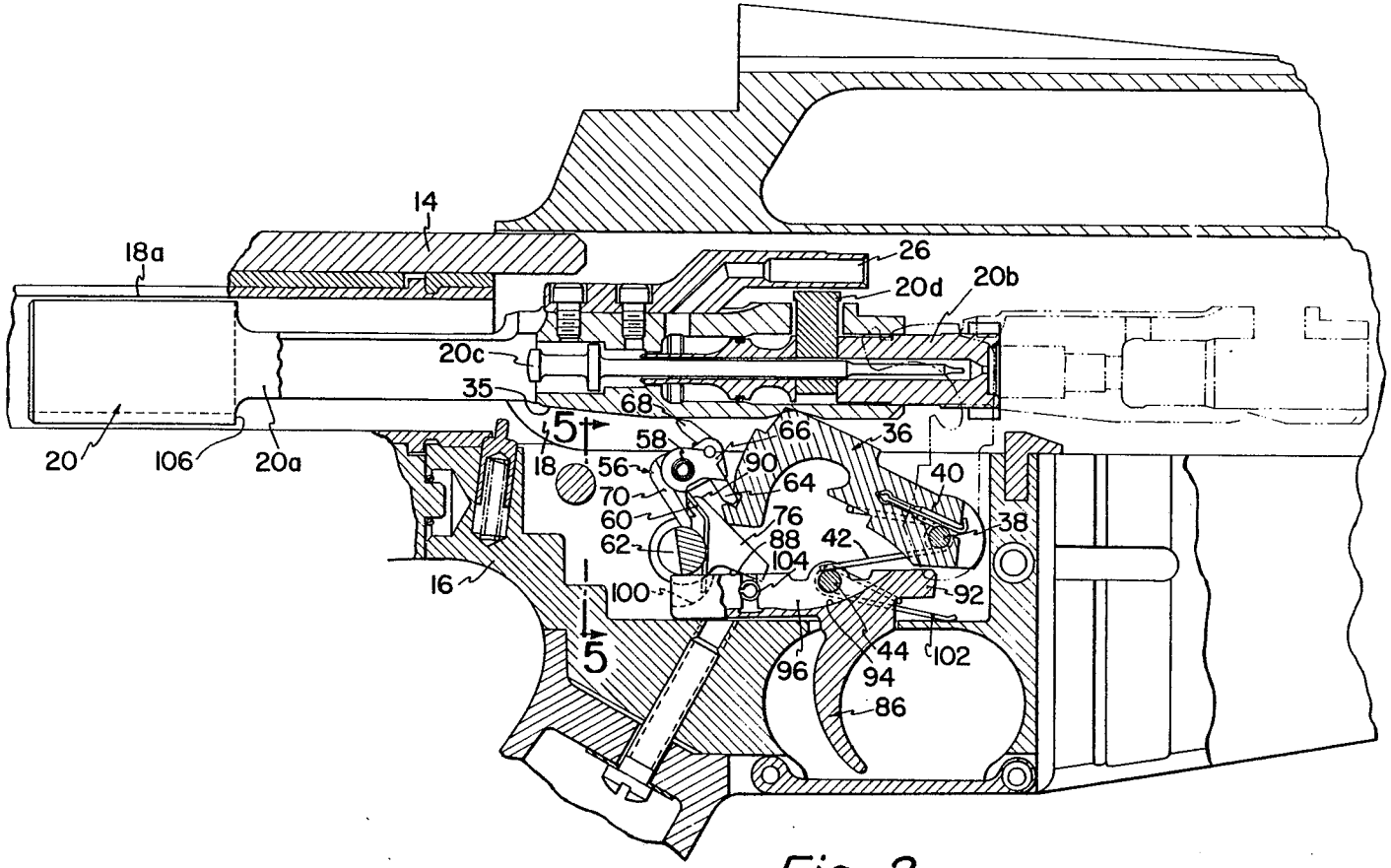
Figure 2A:
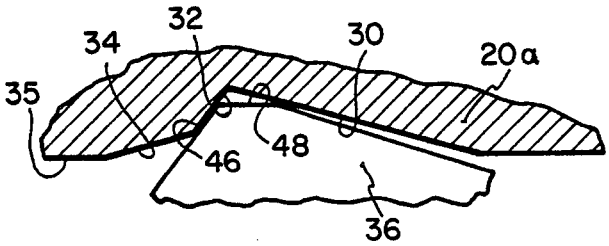
FIG. 2A is an enlarged view of the notch in the bolt carrier.

With reference to FIG. 2, a preferred form of firing mechanism of the invention is shown in the cocked configuration. It will be seen that the bolt assembly 20 is conventional and embodies a bolt carrier 20*a*, a bolt 20*b* mounted in the carrier for axial sliding movement and rotation and a firing pin 20*c* slideably mounted within the bolt 20*b* and the bolt carrier 20*a* for restricted reciprocating axial movement. The bolt assembly 20 also incorporates the usual cam pin 20*d* for producing relative rotation between the bolt 20*b* and bolt carrier 20*a*. However, the contour of the underside of the bolt carrier 20*a* is conspicuously different from that of a conventional bolt carrier in that a notch 30 is provided thereupon. As best shown in FIG. 2A, the notch 30 defines a sear abutment 32 and a contiguous cam surface 34 of lesser slope. It is the engagement between a hammer, generally shown at 36, and the sear abutment 32 which serves to hold the bolt assembly 20 in the cocked position and to terminate counterrecoil thereof.

Figure 2B:
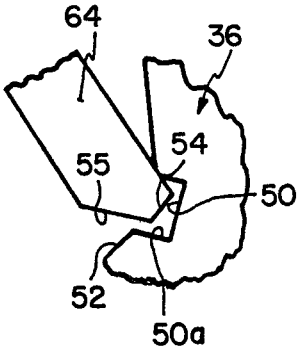
FIG. 2B is an enlarged view of the notch in the hammer.

The hammer 36 is mounted for rotation on a pivot pin 38 and is biased toward the fired position (FIG. 8) by a torsion spring 40 whose lower arm 42 rests upon a pivot pin 44. A corner of the hammer 36 includes a searing surface 46 which engages the sear abutment 32 on the bolt carrier 20*a* and a wear surface 48 extending horizontally at an angle to the searing surface 46. The function of the wear surface 48 is to reduce the wear suffered by the corner of the hammer 36 due to the repeated sliding of the undersurface of the bolt carrier 20*a* thereover. If instead of the wear surface 48 a sharp corner were provided on the hammer 36, the angular position of the hammer in the cocked position could be altered after many thousands of rounds had been fired. The hammer 36 also includes a notch 50 in the upper portion thereof which defines a sear abutment 52 for engaging a searing surface 54 on an automatic sear, generally indicated at 56. As shown in FIG. 2B, the lower wall 50*a* of the notch 50 confronts and is in closely spaced relationship to a surface 55 on the automatic sear which adjoins the searing surface 54.

Figure 3:
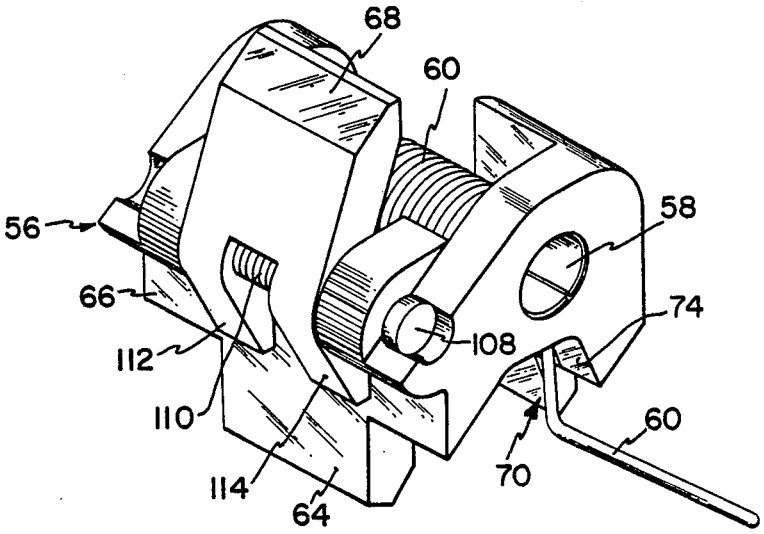
FIG. 3 is a perspective view of the automatic sear, per se.

The automatic sear 56 (shown in perspective in FIG. 3) not only performs its traditional function of releasing the hammer 36 for movement into the fired position but also serves to pull the hammer 36 downwardly to thereby release the bolt assembly 20 for movement to the battery position. With reference to FIGS. 2 and 3, the automatic sear 56 is pivotally mounted on a pivot pin 58 and is biased in a counterclockwise or upward direction by a torsion spring 60 which has its lower arm seated against a safety selector 62 and its upper leg seated against the lower leg 64 of the sear head 66. The sear head 66 also has an upper leg 68 which is more fully described hereinafter. Suffice it to say that, during operation of the firearm, the entire automatic sear 56 acts a one piece element and that no relative movement is beget between legs 64 and 68 or any other portions of the automatic sear 56. The automatic sear 56 has a depending rear tail portion 70, the extremity of which is received within a cutout in the safety selector 62 when the selector is in the off position, whereby pivoting movement of the automatic sear 56 is not impeded. An upper portion of the tail portion 70 has a cam surface 74 fashioned thereupon for engagement by a connector 76, whereby clockwise or downward pivotal motion may be imparted to the automatic sear 56. As depicted in FIG. 2, the safety selector 62 is rotated to the on position, whereby the end of the tail portion 70 is in contact with the outer periphery of the safety selector 62 such that it cannot be pivoted in a clockwise sense to release the hammer 36 for falling movement.

Figure 4:
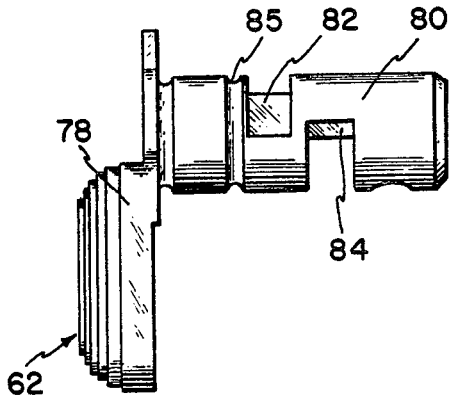
FIG. 4 is a rear elevational view of the safety, per se, as it would appear looking along the line 4—4 of FIG. 6 in the off position.

The safety selector 62 is mounted for rotation on the left hand side of the lower receive section 16 as illustrated in FIG. 2. As best shown in FIG. 4, the safety selector 62 has a handle 78 and pointer which can be pivoted to either of two positions, viz: a safe or on position or an off position in which automatic firing may proceed. The particular illustrated embodiment of the invention has not been provided with a disconnect to permit semiautomatic operation. A cam shaft 80, integral with the handle 78, has recesses or cutouts 82 and 84 milled therein for reception of respective portions of the automatic sear 56 and a trigger, generally shown at 86. During normal operation when the safety selector 62 is off, the cutouts 82 and 84 allow for untrammelled movement of the automatic sear 56 and the trigger 86. An annular groove 85 adjacent the cutout 82 serves to receive an intermediate portion of the lower arm of the spring 60 for restraining lateral movement thereof. A clockwise movement (from the FIG. 2 position) of the selector 62 will render the firing mechanism ready for operation.

Figure 5:
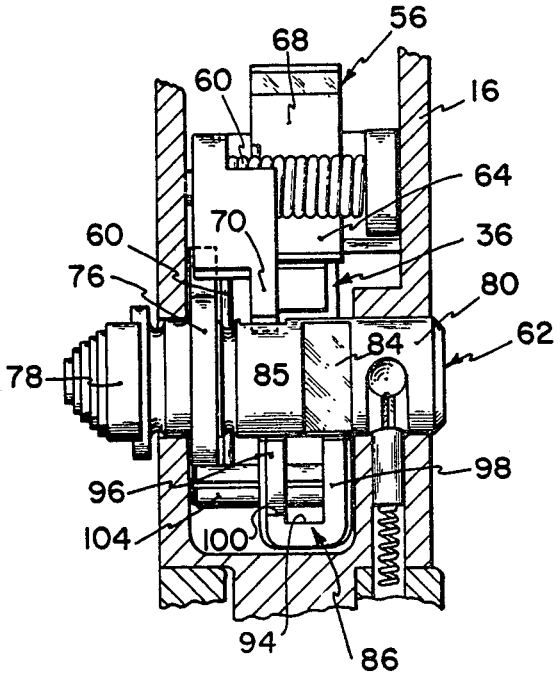
FIG. 5 is a rear elevational view of the firing mechanism, taken substantially along the line 5—5 of FIG. 2, showing the lateral relationship between the trigger, the connector and the safety.

It will be noted from FIGS. 2 and 5, that the connector 76 is mounted for rotation upon the shaft 80 in the lower receiver section 16 and has its lateral movement constrained by its disposition between the receiver wall and the lower arm of the spring 60. The connector 76 has a forwardly extending undersurface 88 which is displaced upwardly as the trigger 86 is pulled such that the connector is pivoted in a counterclockwise sense. The upper part of the connector 76 is formed with a rounded surface 90 which engages the cam surface 74 of the automatic sear 56 for producing clockwise pivoting thereof.

With continued reference to FIG. 2 and 5, it will be noted that the trigger 86 is pivotally mounted upon the transversely oriented pivot pin 44. The trigger 86 has an elongated upper portion 92 which includes an elongated groove or recess 94 bounded by by two vertical sidewalls 96 and 98. The rear portion of the sidewall 96 has a circular sector relief 100 whereby this wall will not contact the selector when the trigger is pulled. The rear portion of the other side wall 98 will engage the outer periphery of the selector when the trigger 86 is pulled when the safety selector 62 is in the on position, whereby trigger 86 cannot be displaced and, of course, the firearm cannot be discharged. Placing the safety selector 62 in the off position will allow the rear portion of the sidewall 98 to enter the recess 84 such that the trigger 86 may be fully pivoted to discharge the firearm. The trigger 86 is biased toward the extended position of FIG. 2 by a torsion spring 102 coiled around the pivot pin 44. The operative connection between the trigger 86 and the connector is accomplished by a pin 104 mounted in the trigger so as to extend transversely from the sidewall 96 in the direction of the left side of the receiver 12. The pin 104 is adapted to contact the undersurface 88 of the connector 76 for producing rotation of the latter about the selector 62 when the trigger 86 is pulled from its extended position to its depressed position.

Figure 6:
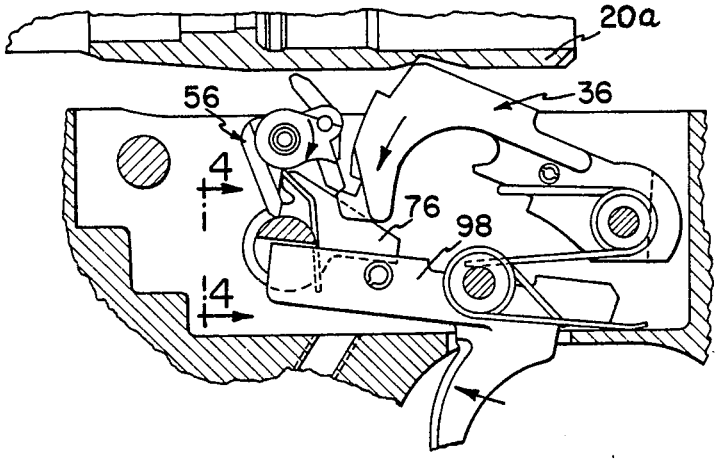
FIG. 6 is a view similar to that of FIG. 2 showing the trigger pulled and the cooperating surfaces on the hammer and the bolt assembly just out of engagement to permit forward movement of the bolt assembly.

In order to commence firing, it is first necessary to rotate the safety selector 62 in the counterclockwise direction to the off position depicted in FIG. 6. With the safety selector 62 in the off position, the vertical sidewall 98 of the trigger 86 may be received in the selector recess 84 and the tail 70 of the automatic sear 56 may move within the recess 82. As shown in FIG. 6, the trigger 86 has been pulled to its fully depressed position. Such a pulling of the trigger results in the connector 76 producing a clockwise rotation of the automatic sear 56, thereby causing the hammer 36 to move downwardly such that the sear abutment 32 of the bolt assembly 20 and the searing surface 46 of the hammer 36 slide out of engagement. As the trigger 86 is pulled, the surface S5 and 50*a* of the automatic sear and the hammer, respectively, come into sliding contact which is terminated as the sear abutment 52 and the searing surface 54 engage each other.

When the sear abutment 32 of the bolt assembly 20 is cleared by the searing surface 46 of the hammer, the bolt assembly 20 is now free to commence movement toward the battery position under the impetus of the operating spring (not shown). As forward motion of the bolt assembly 20 is initiated, surface 34 of the bolt assembly cams the hammer 36 further downwardly to where the undersurface 35 of the bolt carrier slides over the surface 48 of the hammer. The hammer 36 is now in its most rearward or downward position in which sear abutment 52 and searing surface 54 are slightly separated. Engagement between the surfaces 52 and 54 is, of course, reestablished when the undersurface 35 of the bolt carrier retreats sufficiently to permit reengagement.

Figure 7:
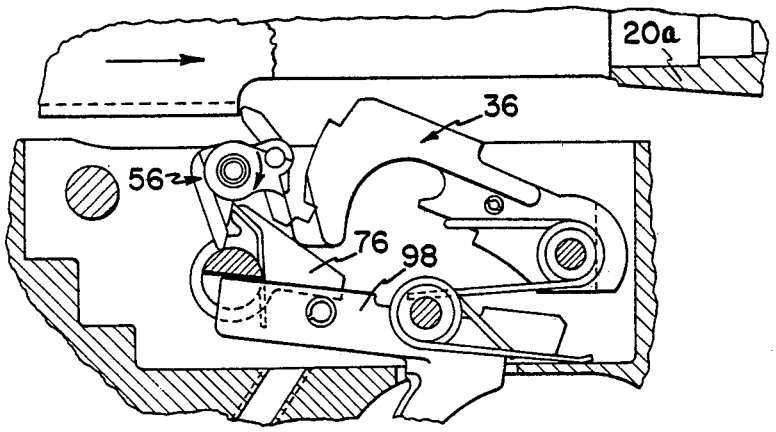
FIG. 7 is a side elevational view in which the bolt assembly is moving toward the battery position and is engaging and starting to rotate the automatic sear to effect hammer release.
Figure 8:
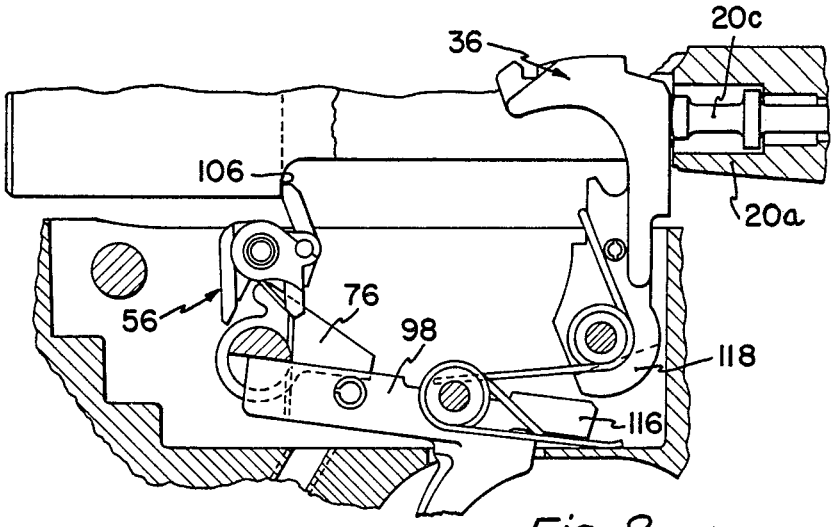
FIG. 8 is a side elevational view which shows the bolt assembly in the battery position and the hammer in its fired position where the firing pin has been displaced forwardly to fire a chambered cartridge.

Turning now to FIG. 7, it will be observed that the bolt assembly 20 has continued its forward motion to point where a shoulder 106 on the bolt carrier 20*a* has engaged the leg 68 of the automatic sear 56 and rotated the automatic sear 56 to a position where the searing surface 54 is about to slide out of engagement with the sear abutment 52. Hence, in FIG. 7, the bolt assembly 20 is just rearward of its battery position. In FIG. 8, the bolt assembly 20 has completed its movement into the battery position, thereby pivoting the automatic sear 56 a few degrees further to a position where the surfaces 52 and 54 are disengaged. Such disengagement has permitted the hammer 36 to fall to the illustrated fired position in which it has struck the firing pin 20*c*.

Figure 9:
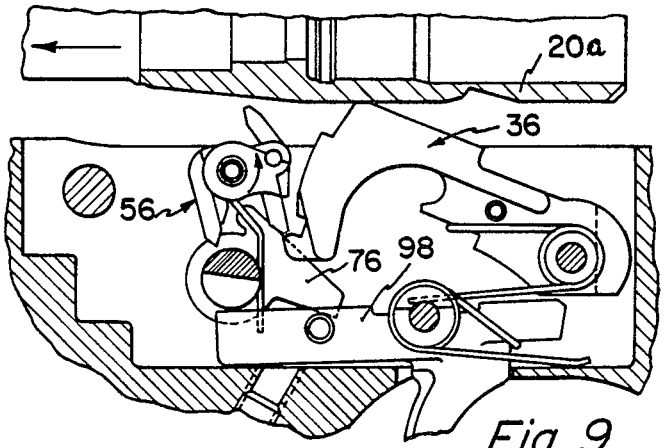
FIG. 9 is a side elevational view showing the bolt assembly in recoil and the hammer depressed rearwardly beyond its cocked position with the trigger released.

With reference to FIG. 9, a cartridge has been fired and the bolt assembly is undergoing recoil. As shown in FIG. 9, the surface 48 of the hammer 36 is in sliding engagement with the undersurface 35 of the bolt carrier 20*a*. Because of the fact that the trigger 86 has been released, the extremity of the lower leg 64 of the automatic sear 56 is now snapping into the hammer notch 50. However, since the trigger 86 is in its released or extended position, the hammer 36 is free to move upwardly to terminate motion of the bolt assembly 20. It should be noted that if the trigger 86 remains pulled or depressed, the hammer 36 will be prevented from moving upwardly a distance sufficient to engage the sear abutment 32 on the bolt carrier and terminate motion thereof owing to the engagement between the searing surface 54 on the automatic sear 56 and the sear abutment 52 on the hammer 36 as shown in FIG. 6.

Figure 10:
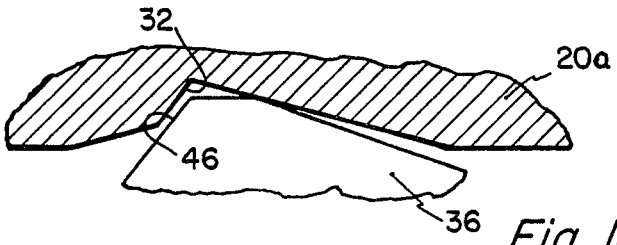
FIG. 10 is a side elevational view showing the bolt assembly in the position in which it is engaged by the bolt stop.

After recoil is completed, the operating spring drives the buffer, and hence the bolt assembly 20, in counterrecoil forwardly toward the battery position. Should the trigger 86 be released and at least one cartridge remain in the magazine, the bolt assembly 20 will have its counterrecoil movement abruptly halted when the searing surface 46 of the hammer contacts the sear abutment 32 of the bolt carrier 20*a*. The surfaces will be brought into confronting relationship by the searing surface 46 moving upwardly within the notch 30. However, assuming the magazine to be empty, then the bolt stop (not shown) will terminate counterrecoil of the bolt assembly 20 in the usual manner. In FIG. 10 the bolt stop has engaged the bolt assembly 20 and is holding the assembly a few fractions of an inch to the rear of the assembly's cocked position. When the bolt stop is released (as for example by the means shown in U.S. Pat. No. 4,057,003) the bolt assembly 20 will move forwardly into the cocked position and the hammer 36 will simultaneously move upwardly within the notch 30 until the searing surface 46 and sear abutment 32 come into engagement.

Since the momentum in a counterrecoiling or forwardly moving bolt assembly must be absorbed by the hammer pivot pin 33, it is highly desirable to minimize the forward velocity of the bolt assembly commensurate with maintaining a reasonable rate of fire. To this end, the hydraulic buffer described in U.S. Pat. No. 3,977,296 is ideally suited to being incorporated in a firearm which employs a firing mechanism of the invention. The buffer of U.S. Pat. No. 3,977,296 is not only advantageous in that it reduces the rate of fire but additionally furnishes a more consistant round to round rate of fire and ameliorates carrier bounce.

In order to facilitate locking the upper receiver section 14 upon the lower receiver section 16, the upper leg 68 of the automatic sear 56 is pivotally mounted upon a pin 108 connected to the sear head. This relationship is best shown in FIG. 3. A torsion spring 110 is coiled about the pin 108 and has its upper arm in abutting relationship with the rear face of the leg 68 so as to urge the leg 68 forwardly such that two juxtaposed extensions 112 and 114 are in firm engagement with the sear head. Hence, during closure of the upper receiver section 14, the rear portion of the bolt carrier 20*a* may depress the leg 68 against the bias of the spring 110. The leg 68 will, of course, snap back to its original position when the carrier is moved to the cocked position. As previously mentioned, leg 68 undergoes no relative pivoting motion with respect to the sear head during operation.

The depicted preferred embodiment is also characterized by virtue of it being impossible to put the safety selector 62 on when the hammer 36 is in the fired position. If it were possible to rotate the safety selector 62 to the on position, the firing mechanism could suffer damage if an attempt were made to cock the weapon. Commonly, such automatic firearms are stored with the components of the firing mechanism in the fired position so as not to maintain the operating spring in the compressed condition for extended periods of time. As perhaps best depicted in FIG. 8, the safety selector 62 cannot be rotated to the on position because the nose 116 of the trigger 86 would contact the rounded base 118 of the hammer 36, thereby preventing further counterclockwise pivoting of the trigger 86 and hence, rotation of the safety selector 62.

It should be clear from the foregoing description that certain changes, alterations, modifications and substitutions can be made without departing from the spirit and scope of the depending claims.

I claim:

1. In an automatic firearm having a receiver, an open bolt firing mechanism of the type having a bolt assembly mounted in the receiver for longitudinal reciprocating movement between rearward recoil and forward battery positions, a sear abutment on the bolt assembly, a hammer, having a sear abutment, mounted in the receiver for pivoting movement between retracted and fired positions and urged to the retracted position by the bolt assembly during its movement between the battery and recoil positions, an automatic sear, having a searing surface to engage the sear abutment on the hammer, mounted in the receiver for downward and upward pivoting movement and for retaining the hammer in a cocked position intermediate the retracted and fired positions and releasing the hammer from the cocked position thereof as the bolt assembly moves into the battery position and a trigger mounted in the receiver for pivoting movement between extended and depressed positions for releasing the bolt assembly from a cocked position intermediate the retracted and battery positions, the improvement in the open bolt firing mechanism comprising:

a searing surface on the hammer to engage the sear abutment on the bolt assembly for stopping forward movement of the bolt assembly from the recoil position such that the bolt assembly assumes its cocked position and for maintaining the bolt assembly in its cocked position; and the automatic sear being operatively connected to the hammer when the bolt assembly is resting in its cocked position such that downward pivoting of the automatic sear produces movement of the hammer toward the retracted position and ultimately disengagement of the sear abutment of the bolt assembly and the searing surface on the hammer, whereby the bolt assembly may move forwardly into the battery position, the searing surface on the automatic sear engaging the sear abutment on the hammer subsequent to the disengagement of the sear abutment of the bolt assembly and the searing surface on the hammer.

2. The improvement of claim 1, further comprising:

a connector pivotally mounted in the receiver and operatively interposed between the trigger and automatic sear for pivoting the automatic sear downwardly when the trigger is pulled from the extended position to the depressed position.

3. The improvement of claim 2, further comprising:

a safety selector mounted for rotation in the receiver between on and off positions such that rotation of the selector to the on position prevents movement of the trigger from the extended position to the depressed position and downward pivoting of the automatic sear.

4. The improvement of claim 1, wherein the sear abutment on the bolt assembly is defined by a notch on the undersurface thereof and wherein the notch further defines a cam surface contiguous with but of a lesser slope than the sear abutment of the bolt assembly, the cam surface serving to pivot the hammer to the retracted position as the bolt assembly moves from the cocked position to the battery position.

5. A method of operating an open bolt firing mechanism which includes a bolt assembly mounted for reciprocating movement between rearward recoil and forward battery positions, a hammer moveable between retracted and fired positions and an automatic sear for retaining the hammer in a cocked position intermediate the retracted and fired positions and releasing the hammer from the cocked position for falling movement as the bolt assembly moves into the battery position, the method comprising the steps of:

engaging the bolt assembly with the hammer during forward movement of the bolt assembly from the recoil position to stop the bolt assembly in a cocked position between the recoil and battery positions and maintain the bolt assembly in its cocked position;

moving the hammer toward the retracted position so as to disengage the hammer and the bolt assembly and allow the bolt assembly to move forwardly from the cocked position to the battery position; and wherein the step of moving the hammer toward the retracted position comprises:

pivoting the automatic sear such that a portion thereof contacts the hammer and moves the hammer toward the retracted position.

6. In an automatic firearm having a receiver, an open bolt firing mechanism of the type having a bolt assembly mounted in the receiver for longitudinal reciprocating movement between rearward recoil and forward battery positions, a sear abutment on the bolt assembly, a hammer, having a sear abutment, mounted in the receiver for pivoting movement between retracted and fired positions and urged to the retracted position by the bolt assembly during its movement between the battery and recoil positions, an automatic sear having a searing surface to engage the sear abutment on the hammer mounted in the receiver for downward and upward pivoting movement and for retaining the hammer in a cocked position intermediate the retracted and fired positions and releasing the hammer from the cocked position thereof as the bolt assembly moves into the battery position and a trigger mounted in the receiver for pivoting movement between extended and depressed positions for releasing the bolt assembly from a cocked position intermediate the retracted and battery positions, the improvement in the open bolt firing mechanism comprising:

a searing surface on the hammer to engage the sear abutment on the bolt assembly for stopping forward movement of the bolt assembly from the recoil position such that the bolt assembly assumes its cocked position and for maintaining the bolt assembly in its cocked position;

the automatic sear having a tail portion with a cam surface and a head with an upper leg to be contacted by the bolt assembly as the bolt assembly moves into the battery position and a lower leg, the extremity of the lower leg of the automatic sear defining the searing surface thereof, the hammer having a notch adjacent its sear abutment which receives the extremity of the lower leg of the automatic sear when the bolt assembly is resting it in cocked position such that downward pivoting of the automatic sear produces movement of the hammer toward the retracted position and ultimately disengagement of the sear abutment of the bolt assembly and the searing surface on the hammer, whereby the bolt assembly may move forwardly into the battery position, the searing surface on the automatic sear engaging the sear abutment on the hammer subsequent to the disengagement of the sear abutment of the bolt assembly and the searing surface on the hammer; and a connector pivotally mounted in the receiver and operatively interposed between the trigger and the automatic sear such that when the trigger is pulled from the extended position to the depressed position the connector is pivoted and the automatic sear is simultaneously pivoted downwardly in an opposite sense by contact between the connector and the cam surface of the tail portion.

7. The improvement of claim 6, further comprising:

a safety selector mounted for rotation in the receiver between on and off positions such that rotation of the selector to the on position prevents movement of the trigger from the extended position to the depressed position and downward pivoting of the automatic sear.

8. The improvement of claim 6, wherein the sear abutment on the bolt assembly is defined by a notch on the undersurface thereof and wherein the notch further defines a cam surface contiguous with but of a lesser slope than the sear abutment of the bolt assembly, the cam surface serving to pivot the hammer to the retracted position as the bolt assembly moves from the cocked position to the battery position.

* * * * *